US006469726B2

(12) United States Patent
Sekiya

(10) Patent No.: US 6,469,726 B2
(45) Date of Patent: Oct. 22, 2002

(54) DRAWER-TYPE LINE THERMAL PRINTER

(75) Inventor: Hiroaki Sekiya, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/931,724

(22) Filed: Aug. 17, 2001

(65) Prior Publication Data

US 2002/0024584 A1 Feb. 28, 2002

(30) Foreign Application Priority Data

Aug. 25, 2000 (JP) ..... 2000-255912

(51) Int. Cl.[7] ..... B41J 29/00; B41J 29/02

(52) U.S. Cl. ..... 347/222

(58) Field of Search ..... 347/222; 400/691, 400/692, 693

(56) References Cited

U.S. PATENT DOCUMENTS 4,641,980 A * 2/1987 Matsumoto et al. ..... 347/222

* cited by examiner

*Primary Examiner*—Huan Tran
(74) *Attorney, Agent, or Firm*—Adams & Wilks

(57) ABSTRACT

In a thermal printer with a drawer-type paper holder, a means is provided, which facilitates the loading of recording paper, reduces the number of parts, and improves the precision in positioning a thermal head and a platen roller, a thermal printer is composed of a first frame 1 by which the thermal head 3 is rotatably supported so that recording paper 8 is brought into pressure contact with a platen roller 4 by a biasing member 5 and a second frame 2 that pivotably supports the platen roller 4, is opened and closed in parallel to the first frame 1, and contains a recording rolled paper 8*a*. The thermal printer has a configuration in which a first cam 3*a* provided in the thermal head 3 is guided by a second cam 2*c* formed in the second frame 2 while being biased by the biasing member 5 and thus the platen roller 4 pivotably supported to the second frame 2 is positioned with respect to the thermal head 3.

4 Claims, 6 Drawing Sheets

DRAWER-TYPE LINE THERMAL PRINTER

BACKGROUND OF THE INVENTION

1. Field of the Invention

The present invention relates to a printer and further a mechanism of separating a platen roller and a thermal head when recording paper is sandwiched between a print head and the platen roller while the print head is brought into pressure contact with the platen roller. Particularly, the present invention relates to a drawer-type thermal printing apparatus (a thermal printer) with improved operability in loading recording paper.

2. Description of the Related Art

There has been an opening/closing structure in which opening and closing are operated by rotational movement of part of a paper holder 10 as shown in FIG. 6, as a structure in which a platen roller is separated from a thermal head considerably and thereby the loading of recording paper is facilitated. The opening/closing structure has become widespread and is characterized in that maintenance such as the loading of recording paper is carried out in a state where the paper holder 10 is opened with a platen roller 4 being supported on a movable side 11 of the paper holder, and the platen roller 4 is positioned with respect to the printer body frame 12 in a state where the paper holder 10 is closed, and thus printing can be carried out.

A conventional thermal printer with the above-mentioned opening/closing structure has a problem in that the thermal head is exposed during operations frequently conducted by a user such as the loading of recording paper or the like. The thermal head is a precision electronic part and tends to be broken easily by static electricity from a human body. Hence, it is undesirable that the thermal head comes into contact with a human body.

SUMMARY OF THE INVENTION

The present invention is intended to provide a means for obtaining a compact, inexpensive printer having high operability that is effective for solving the above-mentioned problem and has a paper holder having a drawer structure, which makes it easy to load printing paper, and prevents a thermal head from coming into contact with a human body.

In order to achieve the above-mentioned object, in a drawer-type thermal printer composed of a first frame with a thermal head mounted thereon and a second frame that can move in parallel to the first frame and also serves as a paper basket for containing recording rolled paper, the invention according to claim 1 has a configuration in which the thermal head is supported pivotably by the first frame, a biasing member is provided for biasing the thermal head for bringing recording paper into pressure contact with the thermal head, the second frame rotatably supports a platen roller, there are provided a first cam provided in the thermal head and a second cam formed in the second frame, and the first cam provided in the thermal head is guided by the second cam formed in the second frame and thereby the platen roller pivotably supported to the second frame is positioned with respect to the thermal head. The shapes of those cams are defined by the shapes of the thermal head and the second frame. Hence, no special member is required for the positioning.

The invention according to claim 2 relates to precision in positioning the thermal head and the platen roller. The first cam provided in the thermal head and the second cam formed in the second frame have a configuration in which the positioning is carried out through the contact therebetween with the first frame and the second frame being in a closed state. With respect to printing and recording paper feed, a rotary driving force of the platen roller acts in the direction in which the second frame is closed with respect to the first frame by friction between the thermal head and the recording paper and thus the precision in positioning the thermal head and the platen roller pivotably supported to the second frame is improved. Thus, it can be expected to obtain high printing quality.

The invention according to claims 3 and 4 are intended to provide the opening and closing of the first frame and the second frame with a sense of operation. The second cam provided in the second frame guides the first cam provided in the thermal head in the direction opposing a biasing force of a biasing member directly before the transition of the second frame with respect to the first frame from an opened state to a closed state and at the instant of the transition from the closed state to the opened state, and thereby a force of operating the opening and closing is provided with moderate resistance. Thus, the sense of operation can be improved and it is possible to prevent the second frame from being brought into an opened state by an external force such as vibration or the like in a printing standby state.

BRIEF DESCRIPTION OF THE DRAWINGS

In the accompanying drawings:

FIG. 1A is a sectional side view taken along line A—A shown in FIG. 2; and FIG. 1B is a sectional side view taken along line B—B shown in FIG. 2;

FIG. 3A is a sectional side view taken along line A—A shown in FIG. 2; and FIG. 3B is a sectional side view taken along line B—B shown in FIG. 2;

FIG. 4A is a sectional side view taken along line A—A shown in FIG. 2; and FIG. 4B is a sectional side view taken along line B—B shown in FIG. 2;

DETAILED DESCRIPTION OF THE PREFERED EMBODIMENTS

The details of a preferred embodiment of the present invention are described with reference to the figures as follows.

Figure 1A:
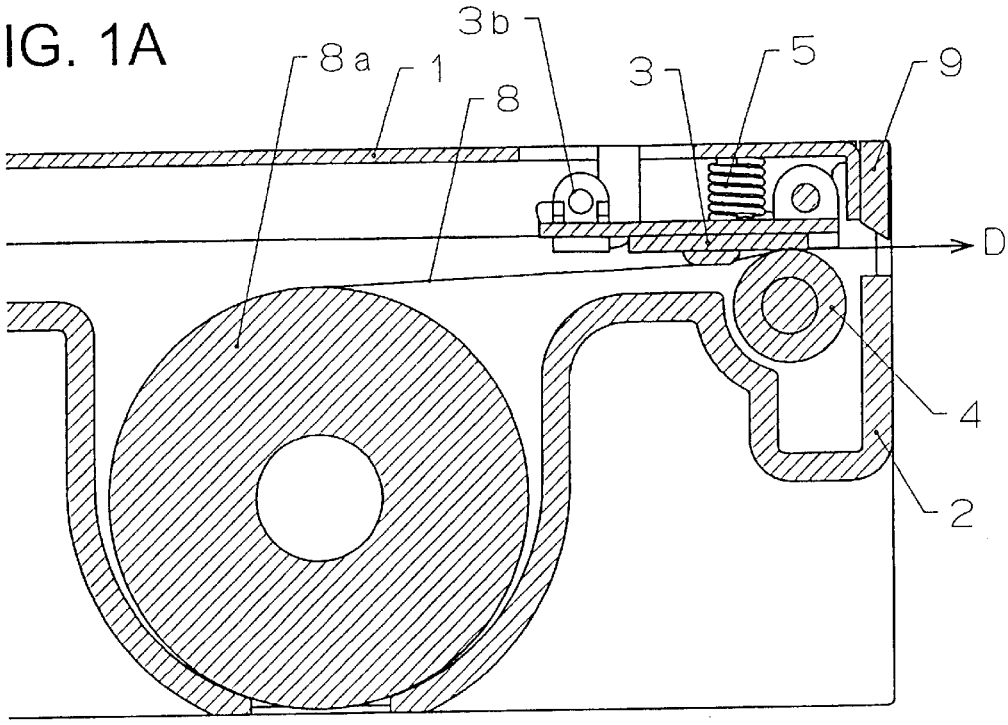
FIG. 1A and FIG. 1B show explanatory side views illustrating an embodiment t of a thermal printer according to the present invention.
Figure 1B:
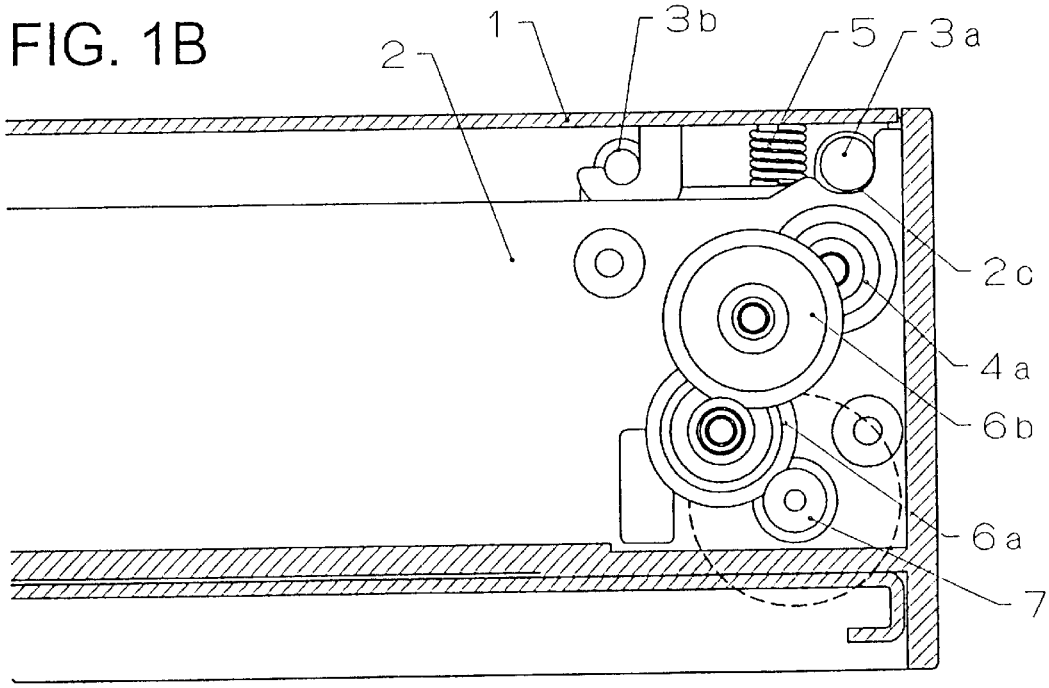
Figure 2:
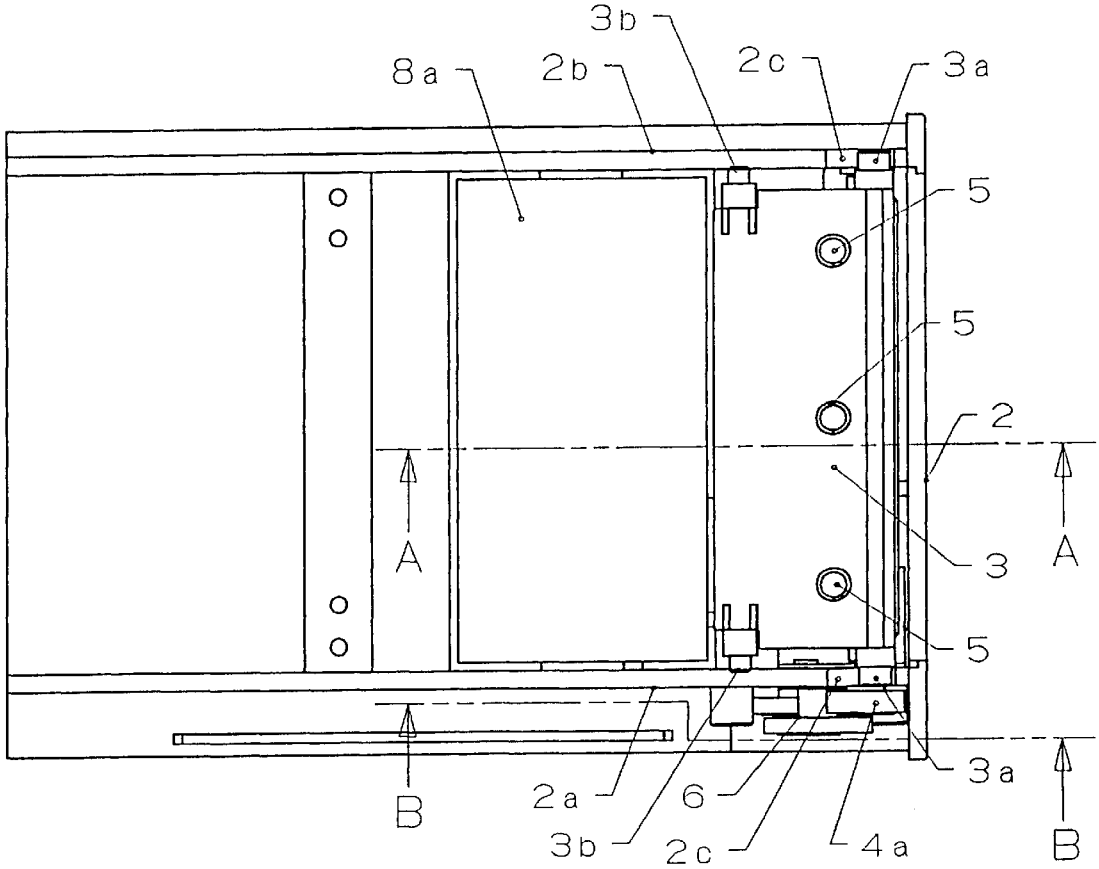
FIG. 2 is a partially perspective plan view of the whole apparatus.
Figure 3A:
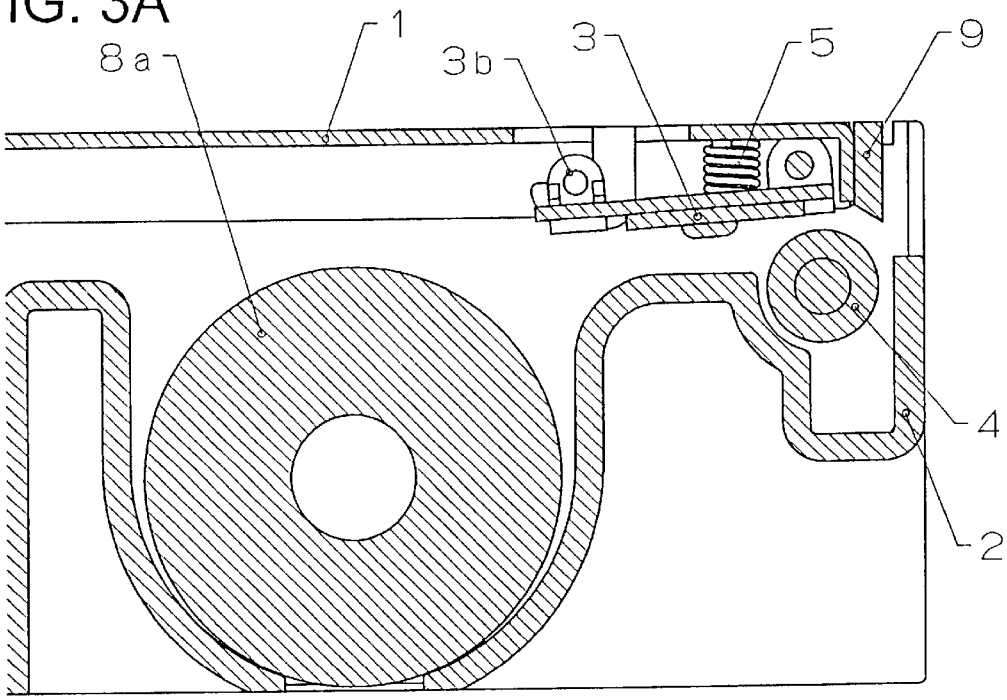
FIG. 3A and FIG. 3B show explanatory side views depicting the process of a movement of a second frame with respect to a first frame.
Figure 3B:
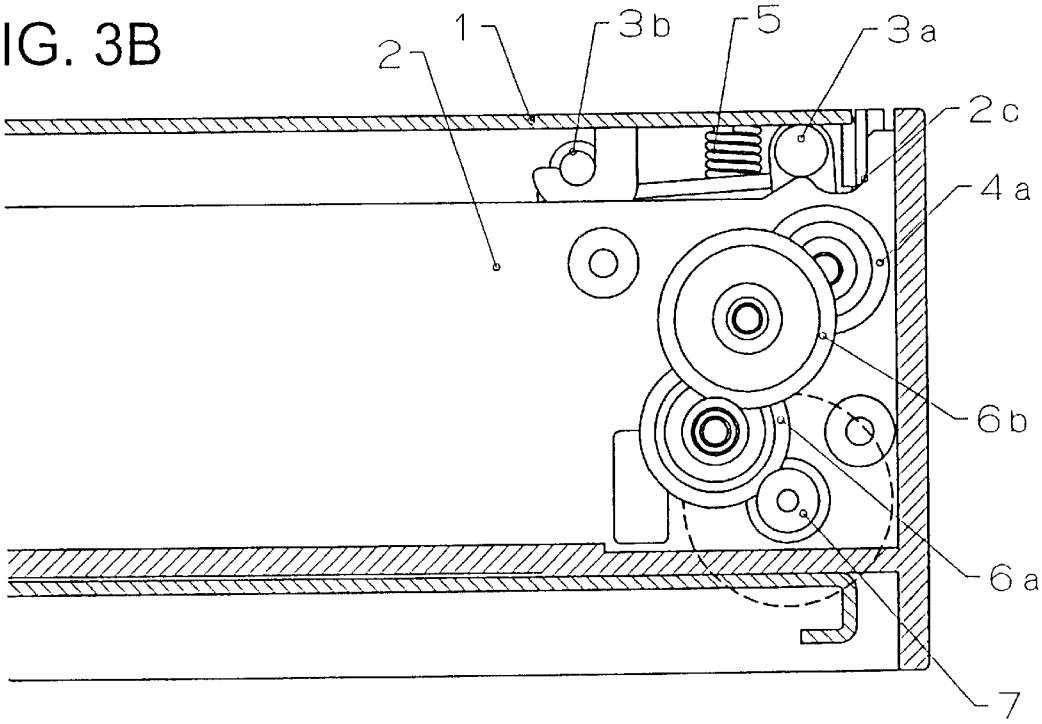
Figure 4A:
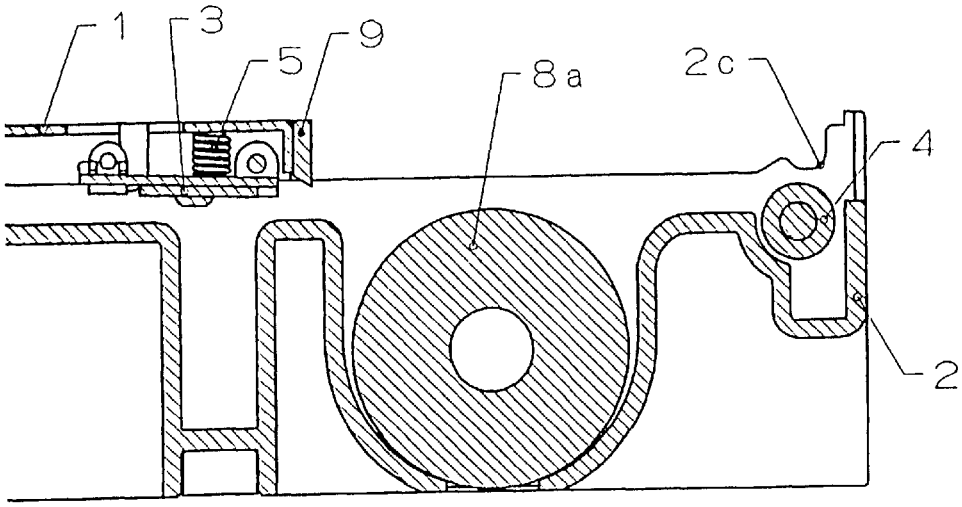
FIG. 4A and FIG. 4B show explanatory side views illustrating a state where the second frame is opened with respect to the first frame.
Figure 4B:
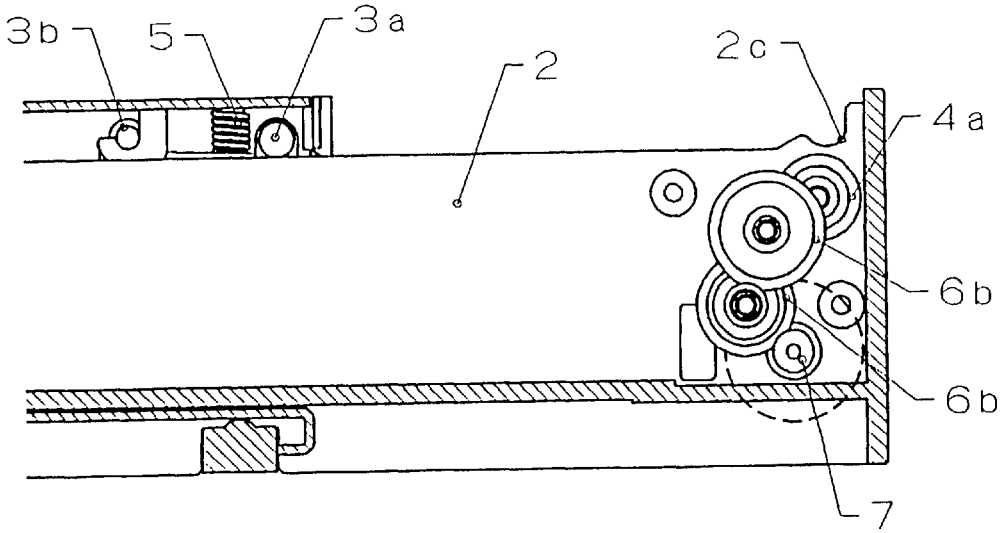
Figure 5:
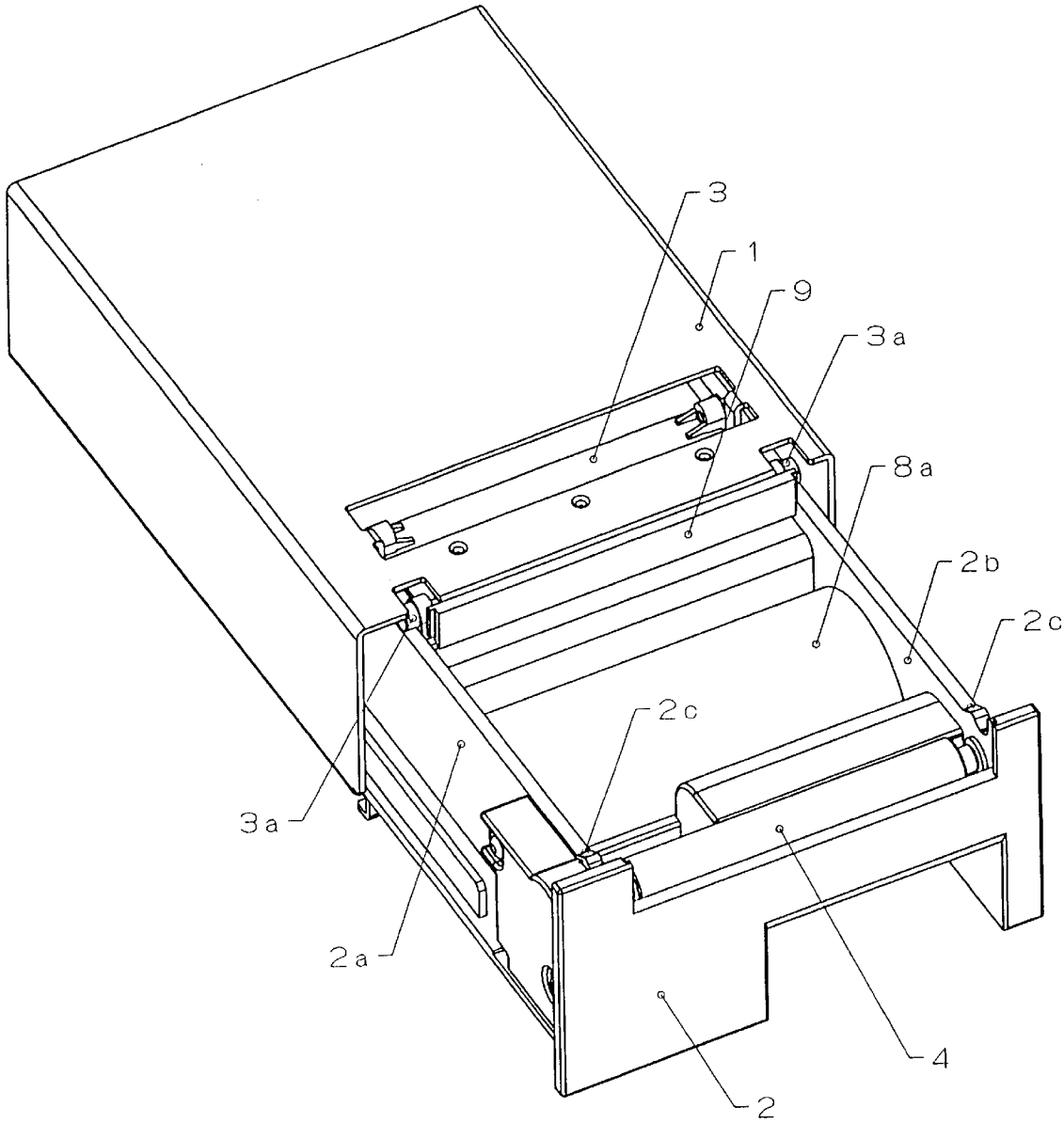
FIG. 5 is a perspective outview showing the whole shape of a thermal printer according to the present invention.
Figure 6:
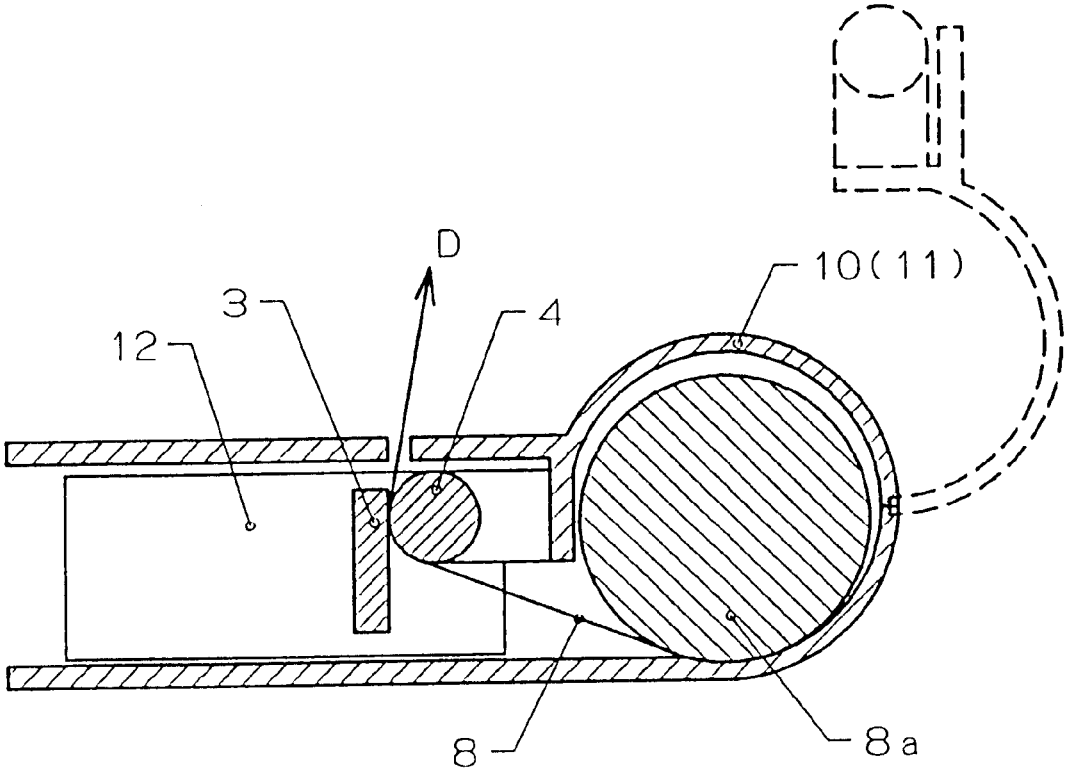
FIG. 6 PRIOR ART
FIG. 6 is a conceptual view of a conventional clamshell-type thermal printer that has become widespread.

FIG. 1 shows explanatory side views illustrating an embodiment of the present invention; FIG. 1A is a sectional side view taken along line A—A shown in FIG. 2; and FIG. 1B is a sectional side view taken along line B—B shown in FIG. 2. FIG. 2 is a partially perspective plan view showing the whole apparatus. FIGS. 3 and 4 depict operations of respective parts upon opening and closing a second frame 2; FIGS. 3A and 4A are sectional side views taken along line A—A shown in FIG. 2; and FIGS. 3B and 4B are sectional side views taken along line B—B shown in FIG. 2. FIG. 5 is a perspective outview depicting the whole shape of a thermal printer according to the present invention. FIG. 6 is a conceptual view of a clamshell-type printer that has become widespread. FIGS. 1, 3, and 4 show main parts, as sectional views, of the thermal printer of the embodiment described here so as to depict its characteristic configuration simply.

FIG. 1 shows explanatory side views illustrating the closed state of a first frame and a second frame and depicts the conditions during printing and standby. A thermal head 3 is pivotably supported to the first frame 1 by a head supporting shaft 3*b* provided in the thermal head 3. A biasing member 5, a compression coil spring in this embodiment, is disposed on the back face of the thermal head 3. A platen roller 4 is rotatably provided in the horizontal direction between sidewalls 2*a* and 2*b* of the second frame 2 shown in FIG. 2. The sidewall 2*a* is provided with a speed reducer 6 for driving the platen roller 4. The thermal head 3 biased by the biasing member 5 is in pressure contact with thermal recording paper (hereinafter referred to as "recording paper") 8 between the platen roller 4 and the thermal head 3. Recording rolled paper 8*a* is used as the recording paper and is contained in the second frame. A rotary motor 7 is fixed to the second frame. A rotary motion of the motor 7 propagates from reduction gears 6*a* and 6*b* composing the speed reducer 6 to a platen driving gear 4*a* fixed to the platen roller 4 and thus the platen roller 4 is rotated clockwise in FIG. 1A to send the recording paper 8 in a paper ejection direction D. Printing is carried out by the passage of electric current through the thermal head 3 in synchronization with the rotation of the motor 7.

The following description is directed to functions of a first cam 3*a* and a second cam 2*c* and the opening/closing operations of the first frame 1 and the second frame 2.

FIG. 1 depicts a printing and printing-standby state, which is a so-called closed state of the first frame 1 and the second frame 2. Slight play is provided between the first cam 3*a* and the second cam 2*c* in the downward direction in FIG. 1. This is intended to exert the biasing force of the biasing member 5 for the pressure contact between the thermal head 3 and the recording paper 8, which is the original object. Hence, the first cam 3*a* and the second cam 2*c* are positioned with the play provided therebetween. However, the rotary driving force of the platen roller 4 pivotably supported to the second frame acts during printing in the direction in which the second frame 2 is closed with respect to the first frame 1, i.e. in the leftward direction in FIG. 1B by the friction between the recording paper 8 and the thermal head 3. Hence, the second frame is moved in the leftward direction in FIG. 1B and thus the precision in positioning the thermal head 3 and the platen roller 4 is not deteriorated due to the play.

When an external force such as human power acts on the second frame in the direction in which the second frame is opened with respect to the first frame, i.e. in the rightward direction in FIG. 1B, as shown in FIG. 3B, the first cam 3*a* follows the shape of the second cam to be guided in the upward direction in FIG. 3B. The thermal head 3 thereby opposes the biasing force of the biasing member 5 to compress the biasing member 5. This state is shown in FIG. 3A. Further, when the second frame moves in the direction in which the second frame is opened with respect to the first frame, as shown in FIG. 4B, the first cam 3*a* follows the shape of the second cam to be guided in the downward direction in FIG. 4B. The biasing member 5 that has been compressed as shown in FIG. 3 is thereby released from the compressed state. Thus, the change in the biasing force produced by the compression and release of the biasing member 5 produces a force for operating opening and closing of the second frame 2 and provides the movement with a sense of operation. In FIG. 4, the second frame is exposed considerably and in this state, the recording rolled paper 8*a* is loaded or replaced.

Next, the description is directed to an operation of closing the second frame 2 with respect to the first frame 1. The closing operation is opposite in procedure to the opening operation. When the second frame 2 is moved in the leftward direction in FIG. 4B, as shown in FIG. 3B, the first cam 3*a* follows the shape of the second cam 2*c* again to be guided in the upward direction in FIG. 3B. The thermal head 3 thereby moves in the direction going away from the platen roller 4 as shown in FIG. 3A and thus the contact of the end face of the thermal head 3 with the platen roller 4 is avoided. This movement prevents the surface of the platen Loller 4 from being damaged by the end face of the thermal head 3.

Further , when the second frame 2 moves in the leftward direction in FIG. 3B, the first cam 3*a* is guided by the second cam 2*c* and this results in the state shown in FIG. 1. Also in this closing movement, the biasing member 5 performs the compression and release and thereby the movement of the second frame 2 is provided with the sense of operation.

As described above, according to the mechanism of the drawer-type line thermal printer of the present invention, a drawer-type thermal printer can be provided in which the thermal head pivotably supported to the first frame can be positioned with high precision with respect to the platen roller pivotably supported to the drawer-type second frame, a highly reliable opening/closing operation and a secure sense of operation can be achieved with a small number of parts, and the maintenance such as the loading of recording paper is facilitated.

What is claimed is:

1. A thermal printer comprising: a line-dot-type thermal head; a first frame pivotably supporting the thermal head; a biasing member for biasing the thermal head to bring recording paper into pressure contact with the thermal head; a drawer-shaped second frame that can move in parallel to the first frame and contains recording rolled paper; a platen roller rotatably supported to the second frame; a first cam provided in the thermal head; and a second cam formed in the second frame, characterized in that the first cam provided in the thermal head is guided by the second cam formed in the second frame, so that the platen roller pivotably supported to the second frame is positioned with respect to the thermal head.

2. The thermal printer according to claim 1, characterized in that a direction in which the recording paper moves on the thermal head during printing is substantially the same as that in which the second frame is drawn from the first frame.

3. The thermal printer according to claim 1, characterized in that the second cam formed in the second frame guides the first cam provided in the thermal head in a direction opposing a biasing force of the biasing member at the instant of transition of the second frame and the first frame from a closed state to an opened state.

4. The thermal printer according to claim 1, characterized in that the second cam formed in the second frame guides the first cam provided in the thermal head in a direction opposing a biasing force of the biasing member directly before transition of the second frame and the first frame from an opened state to a closed state.

* * * * *